US006812817B2

(12) United States Patent
Thibideau

(10) Patent No.: US 6,812,817 B2
(45) Date of Patent: Nov. 2, 2004

(54) VERSATILE MAGNETIC HOLDER

(75) Inventor: Todd J. Thibideau, Maple Ridge (CA)

(73) Assignee: Dragonslayer Investments Inc., Maple Ridge (CA)

( * ) Notice: Subject to any disclaimer, the term of this patent is extended or adjusted under 35 U.S.C. 154(b) by 10 days.

(21) Appl. No.: 10/385,730

(22) Filed: Mar. 12, 2003

(65) Prior Publication Data

US 2003/0155997 A1 Aug. 21, 2003

Related U.S. Application Data

(63) Continuation of application No. PCT/CA01/01302, filed on Sep. 11, 2001.

(51) Int. Cl.[7] ..... H01F 7/20
(52) U.S. Cl. ..... 335/285; 335/306
(58) Field of Search ..... 335/285, 296–306; 24/303

(56) References Cited

U.S. PATENT DOCUMENTS

| | | | | |
|---|---|---|---|---|
| 3,112,638 A | | 12/1963 | Bey | 70/459 |
| 3,792,511 A | * | 2/1974 | Evans | 33/458 |
| 4,592,157 A | | 6/1986 | Kerr | 40/2 A |
| 5,388,439 A | | 2/1995 | Miller | 70/456 R |

FOREIGN PATENT DOCUMENTS

| | | |
|---|---|---|
| CA | 2035560 | 8/1991 |
| CA | 1333272 | 11/1994 |
| CA | 2188119 | 4/1998 |
| DE | 29717216 | 11/1997 |
| FR | 2613192 | 10/1988 |
| GB | 2138281 | 10/1984 |

* cited by examiner

*Primary Examiner*—Ramon M. Barrera
(74) *Attorney, Agent, or Firm*—Oyen Wiggs Green & Mutala

(57) ABSTRACT

The invention provides a versatile magnetic holder which is capable of holding objects which are sensitive to magnetic fields, such as ferrous coins, capable of holding items comprising an enclosed loop, such as key chains, and capable of holding thin articles, such as paper currency, which can be held between two adjacent flat elements pressing against one another. The magnetic holder is also capable of securing larger objects against a ferrous portion of another object. The apparatus comprises three longitudinal flat members, each member comprising two magnets protruding from one face, linked through one another via a loop-shaped element extending through a hole positioned at an extremity of each longitudinal member. For maximum versatility, when all three longitudinal members are magnetically secured to one another, the top face of two of the longitudinal members faces in opposite direction to the front face of the third longitudinal member.

17 Claims, 6 Drawing Sheets

VERSATILE MAGNETIC HOLDER

CROSS-REFERENCE TO RELATED APPLICATIONS

This is a continuation of PCT application No. PCT/CA01/01302 filed on 11 Sep. 2001 entitled VERSATILE MAGNETIC HOLDER, and claims priority from Canadian application No. 2319707 filed on 12 Sep. 2000.

FIELD OF THE INVENTION

This invention relates to an apparatus for holding small items and for assisting in holding, in whole or in part, items against magnetic surfaces. The apparatus has specific application to holding personal objects of the type that a person might carry in a pocket such as magnetic coins, paper or plastic currency, keys, smart cards and the like. The apparatus has also specific application to removably holding a protective article, such as a tarpaulin drop sheet or the like, against a magnetic object, such as a vehicle.

BACKGROUND

Various types of devices exist for holding miscellaneous personal objects such as currency, keys, access cards, and the like which are typically carried by individuals. Some such devices include a magnet. Magnetic items such as magnetic coins are attracted to the magnet and can be held to the magnet. One example of a magnetic holder is described in U.S. Pat. No. 5,388,439 (Miller). A magnetic holder is not useful for holding non-magnetic items such as non-magnetic coins, paper currency or the like.

Another type of holding device comprises a member, typically a loop, onto which can be fastened apertured objects such as keys. A standard key ring is an example of such a device. Examples of such devices are disclosed in Canadian patent No. 2,188,119 (MacLeod), Canadian patent No. 1,333,272 (Tsamas) and Canadian patent No. 2,035,560 (Scungio). This type of device is not useful for holding items, such as money, which are not apertured.

A further type of holding device comprises a pair of adjacent elements which are biased together with sufficient force to enable objects, such as paper currency, identification cards and the like to be removably secured. A standard money clip is an example of such a device. Another example of a device in which objects can be gripped between adjacent surfaces is described in U.K. patent 2,138,281 (Huang), where coins and paper currency can be held between adjacent coils of a spiral.

There is a need for a versatile, convenient to carry, apparatus capable of removably securing personal objects. There is also a need for an apparatus capable of securing larger objects against a magnetic portion of another object.

SUMMARY OF THE INVENTION

This invention provides a versatile magnetic holder, comprising three longitudinal magnetic members each comprising a magnetizable material. Each magnetic member comprises an aperture through which a loop-shaped element can extend, positioned in an end portion of the magnetic member, and two ferromagnetic elements on the magnetic member. The ferromagnetic elements are preferably rare-earth magnets.

The magnetic holder may comprise an aligning member, such as a key ring or a flexible strap, extending through the apertures of the magnetic members.

The ferromagnetic elements are arranged so that the poles of ferromagnetic elements on adjacent magnetic members attract one another, so that the three magnetic members are magnetically secured to one another.

The three magnetic members are preferably arranged with respect to one another so that, when they are magnetically secured to one another, the front faces of two of the magnetic members face in one direction while the front face of a third magnetic member faces in an opposite direction. The front face of each of the magnetic members may comprise a spacer. Alternatively, the ferromagnetic elements may project from the front face of each of the magnetic members to serve as spacers.

Preferably, the ferromagnetic elements are curved along their longitudinal axis, with their back sides being convex.

This invention also provides a method for simultaneously holding small magnetic objects such as coins, loop shaped elements and thin articles. The method comprises providing a holder, as outlined above. The method further comprises inserting one or more thin articles between the back side of one magnetic member and the back side of another magnetic member. The method further comprises magnetically securing a magnetic object to any one of the ferromagnetic elements. The method further comprises inserting a loop shaped element in gaps formed by the holder. A gap is formed when two ferromagnetic elements (or other spaces) projecting from the front face of one magnetic member are magnetically secured to the back side of another magnetic member. A gap is also formed when two ferromagnetic elements projecting from the front face of one magnetic member are magnetically secured to two ferromagnetic elements projecting from the front face of another magnetic member.

Further features and advantages of the invention are described below.

BRIEF DESCRIPTION OF THE DRAWINGS

In drawings which illustrate non-limiting embodiments of the invention.

DETAILED DESCRIPTION

As required, detailed embodiments of the present invention are disclosed herein. However, it is to be understood that the disclosed embodiments are merely exemplary of the invention, which may be embodied in various forms. Therefore, specific structural and functional details disclosed herein are not to be determined as limiting, but merely as a basis for the claims and a representative basis for teaching one skilled in the art to variously employ the present invention in virtually any appropriately detailed structure.

This invention provides a versatile holder for holding items such as coins, paper currency, keys, smart cards, and the like. A preferred embodiment of the invention comprises a number of generally flat magnetic plates. The plates are attracted to one another by magnetic forces so that paper currency or other thin objects can be held between a pair of adjacent plates. Magnetic items such as ferromagnetic coins are held to the holder by magnetic attraction to the plates. Most preferably the plates are all mounted on a connecting member, such as a ring, which passes through apertures in end portions of the plates. Objects such as keys or smart cards may also be held to the connecting member. Thus a holder according to the invention can conveniently accommodate a wide range of small objects of types that an individual might carry in his or her pockets.

Figure 1:
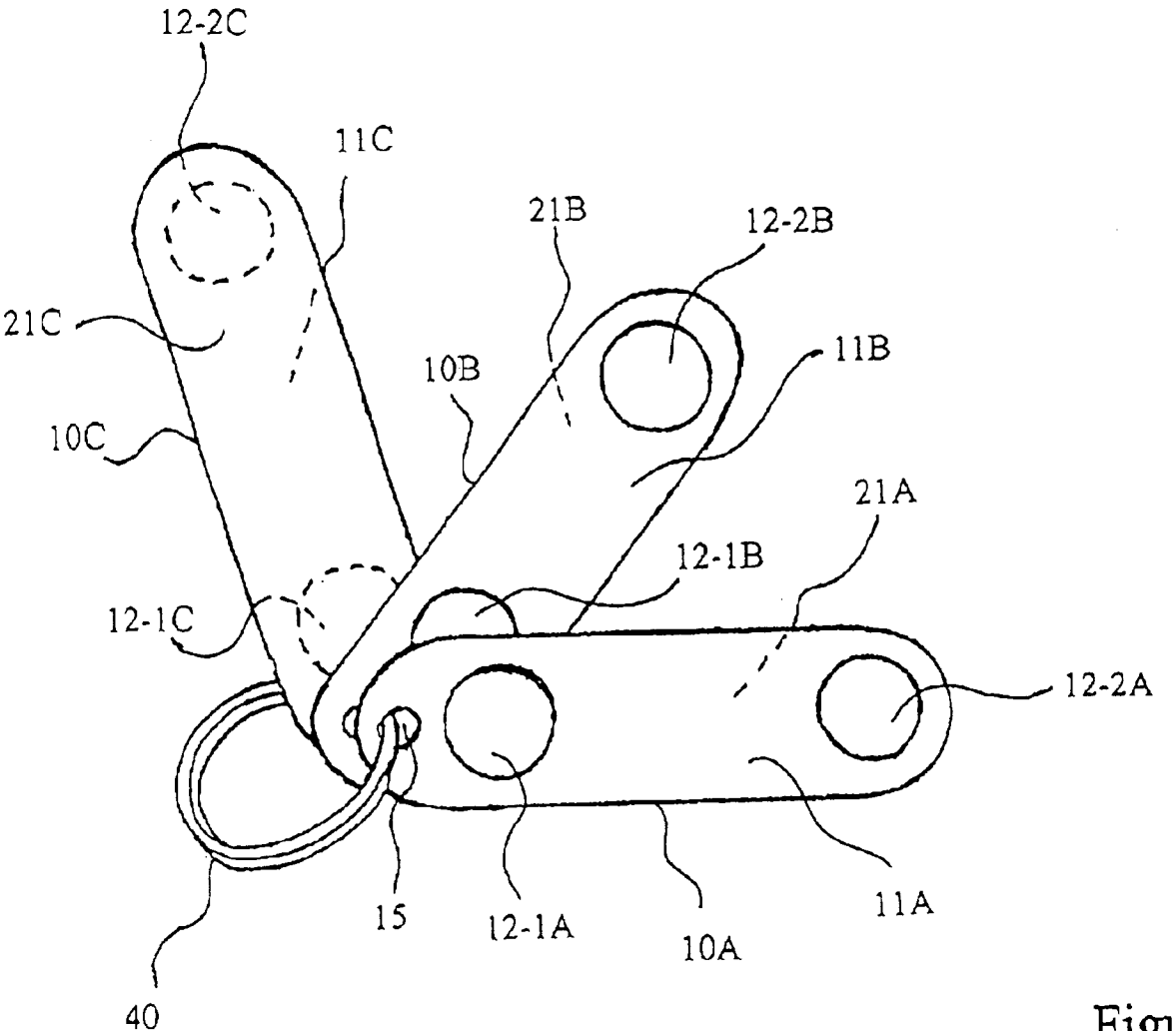
FIG. 1 is a schematic top view of a magnetic holder according to a preferred embodiment of the invention.
Figure 2:
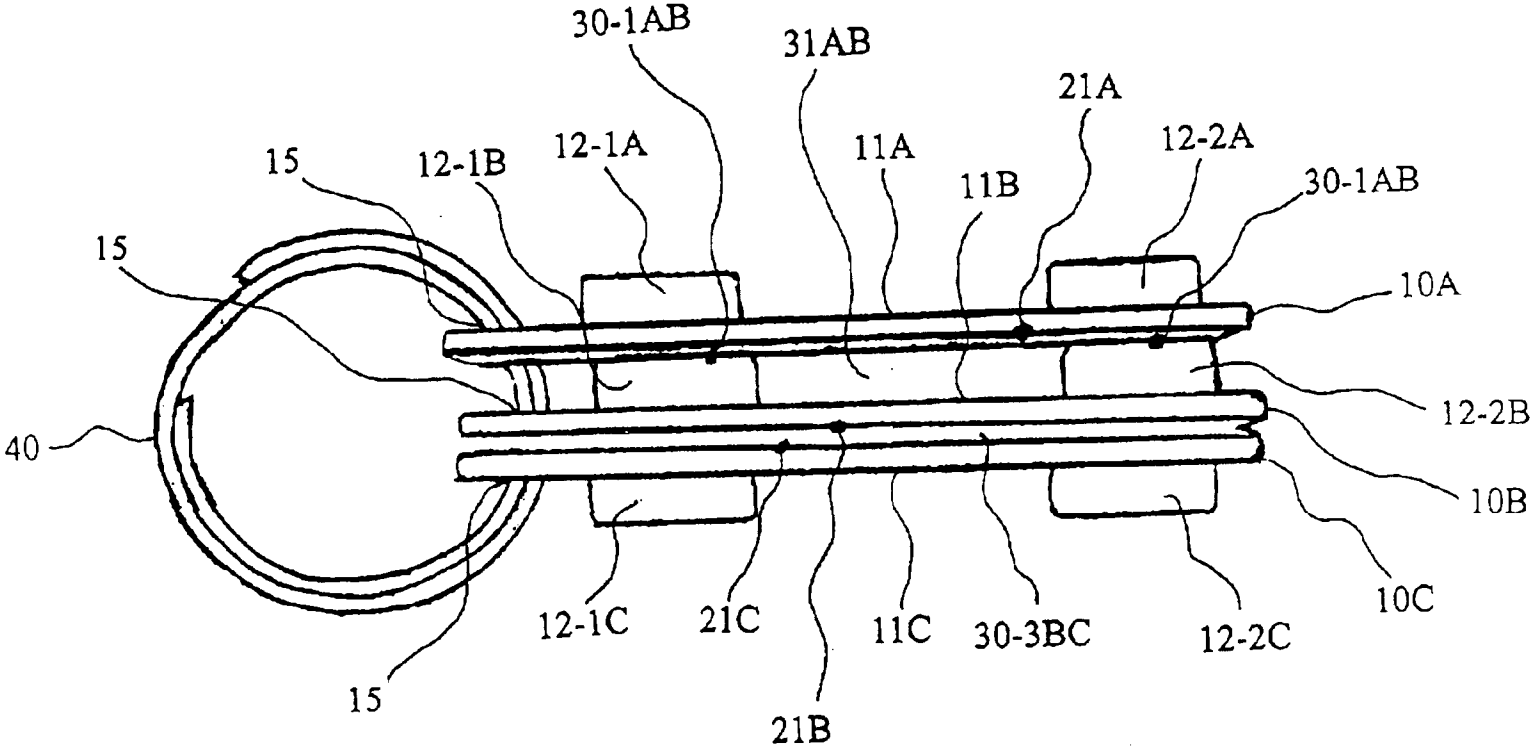
FIG. 2 is a schematic side view of the magnetic holder of FIG. 1.

As shown in FIGS. 1 and 2, a holder 1 according to a currently preferred embodiment of the invention, comprises three generally flat elongated ferrous members 10. Members 10 include a first flat member 10A, a second flat member 10B and a third flat member 10C. In the preferred embodiment, each flat member 10 is made of 18 gage cold rolled steel. Members 10 are preferably stiff. Where the members are fabricated from 18 gauge steel, they are preferably slightly curved or slightly bent about a longitudinal axis, as shown for example in FIG. 6, to provide added stiffness. Magnetizable materials other than steel may also be used for members 10. Each of members 10 preferably has suitable dimensions to fit into a user's pocket. To be pocket size, holder 1 should not be longer than about 100 mm and is preferably ½ this size. For example, in the preferred embodiment, each member 10 is approximately 15 mm wide, 50 mm long and 1 mm thick. Preferably, each end of each flat member is rounded so that members 10 have no sharp corners.

One end portion 16 of each member 10, includes an aperture 15 through which an aligning member, such as a ring or flexible strap, can extend. In the preferred embodiment, the aligning member comprises a ring 40. Ring 40 is preferably a ring such as a key ring onto which additional things such as keys, bar-coded identification tags, tags bearing advertisements, smart cards or the like can be added. Aligning member 40 keeps end portions 16 of members 10 generally aligned with one another and keeps members 10 together.

Figure 6:
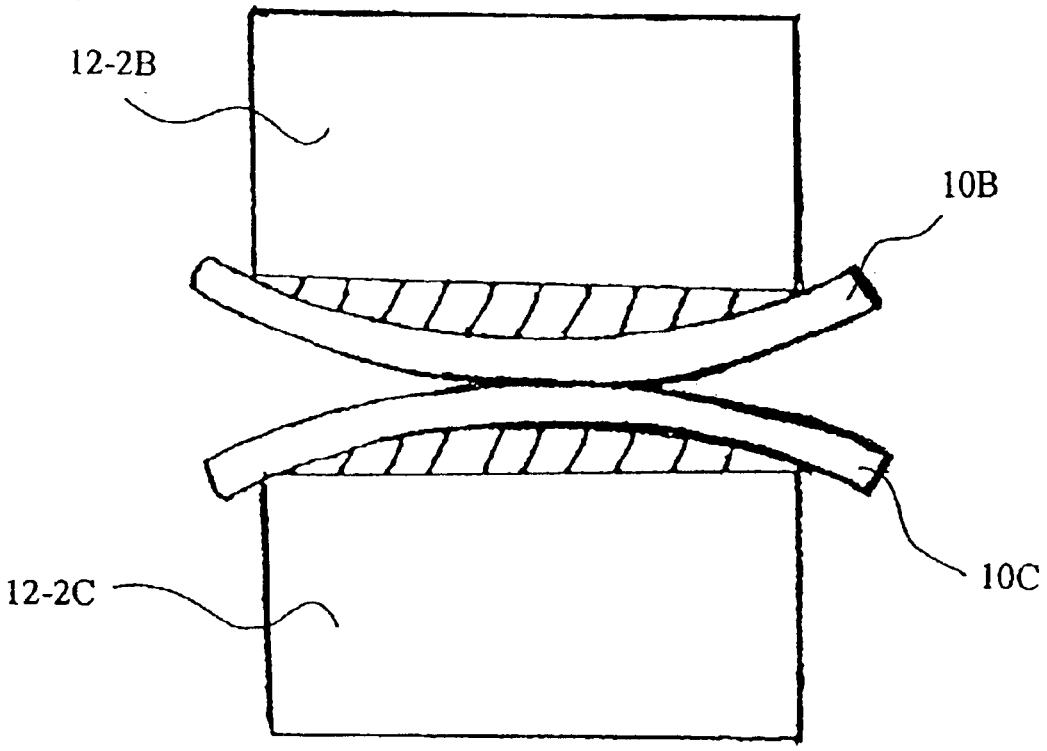
FIG. 6 is a schematic view along line 6—6 of FIG. 5.

Each of members 10 has a front face 11 and a back side 21. In the preferred embodiment, back side 21 is slightly convex as shown in FIG. 6. Two ferromagnetic elements 12 are mounted to the front face 11. On each member 10, one magnetic element 12-1 is secured near a first, proximal, end 16 and a second magnetic element 12-2 is secured near a second, distal, end 17, of magnetic member 10. Magnetic elements 12-1 and 12-2 are preferably spaced apart from one another by the same amount on each of members 10. In the preferred embodiment, each pair of ferromagnetic elements (i.e. ferromagnetic elements 12-1A and 12-2A, ferromagnetic elements 12-1B and 12-2B and ferromagnetic elements 12-1C and 12-2C) are spaced apart from one another by a distance of approximately 30 mm. Magnetic elements 12 project slightly from front face 11. Ferromagnetic elements 12 may be held in place on face 11 mechanically or may be held in place using a suitable adhesive. In the preferred embodiment, ferromagnetic elements 12 each comprise a rare earth permanent magnet. Such magnets produce magnetic fields which are strong in relation to the size and weight of the magnet. Other strong magnets could also be used for ferromagnetic elements 12.

Ferromagnetic elements 12 tend to cause holder 1 to adopt a configuration in which each ferromagnetic element 12 is aligned with a corresponding ferromagnetic element on an adjacent member 10. This configuration is shown in FIG. 2. A user can slide members 10 apart into a fan configuration as shown in FIG. 1.

Figure 5:
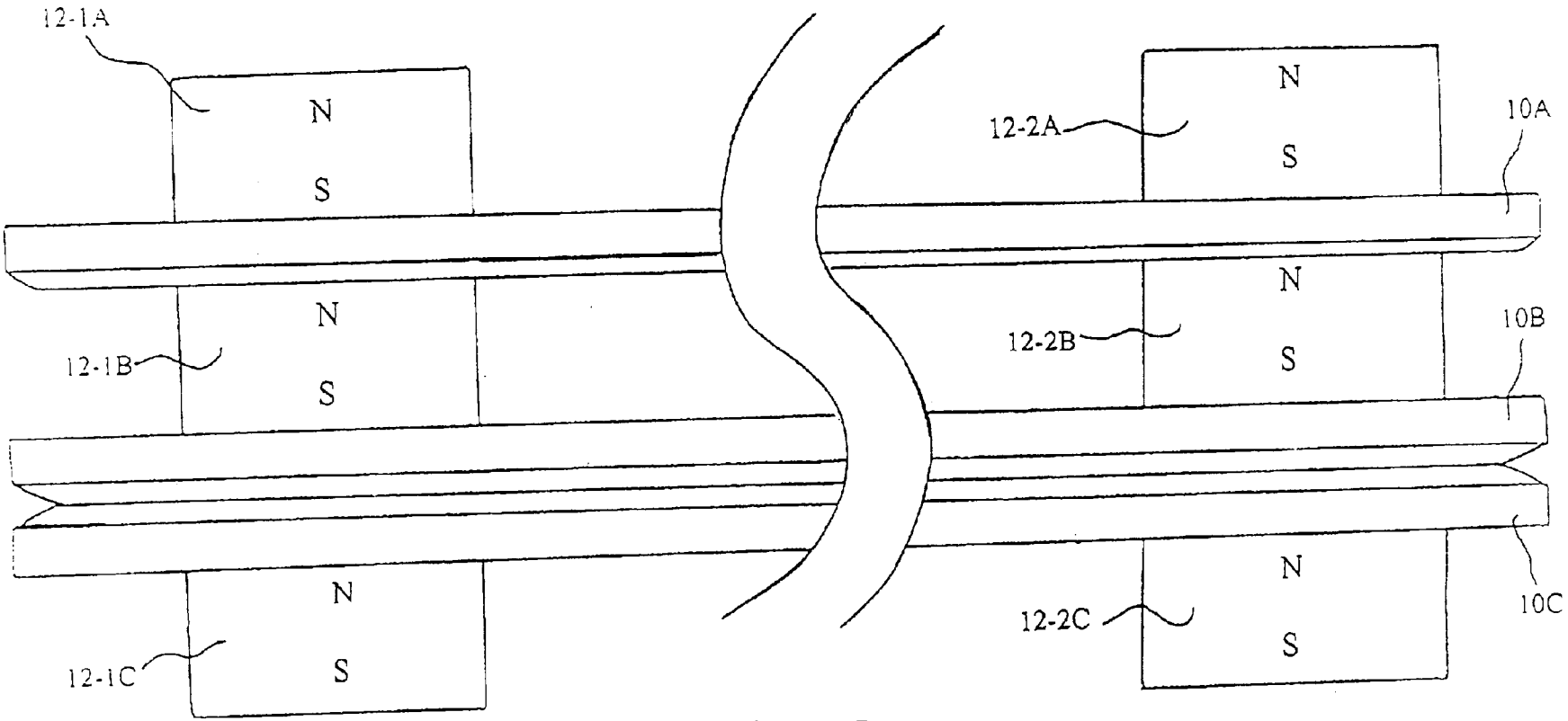
FIG. 5 is a schematic side view of a preferred arrangement of poles of each magnet of the magnetic holder of FIG. 1.

FIG. 5 shows a preferred arrangement of magnetic poles, where N indicates a north magnetic pole and S indicates a south magnetic pole, for each of magnetic elements 12-1 and 12-2 of magnetic holder 1. This arrangement creates optimal attractive forces between flat members 10A, 10B and 10C, because opposite poles are adjacent to one another (for example north magnetic pole N of magnet 12-2B is adjacent to south magnetic pole S of magnet 12-2A). In the preferred embodiment, the poles of all of the ferromagnetic elements 12 on a member 10 face in the same direction. However, any arrangement of the magnets which preserves this concept of adjacent distribution of opposite poles is possible within the broad scope of this invention.

According to a preferred embodiment of the invention, as shown in FIG. 2, faces 11 of two adjacent ones of members 10 face one direction (in the illustrated embodiment members 10A and 10B have their faces, 11A and 11B, facing one direction). The third member 10C has its face 11C oriented in a direction opposite to that of faces 11A and 11B of the other two members 10. With this construction, front faces 11 (i.e. 11A and 11B) of two flat members 10A and 10B face one way and the front face 11 (i.e. 11CB) of the third flat member 10C faces the opposite way.

More specifically, FIG. 2 shows a first flat member 10A positioned on top of the other two flat members (10B and 10C) in holder 1, with its front side 11A and magnetic elements 12-1A and 12-2A facing upwards. Second flat member 10B is positioned under first flat member 10A with its front side 11B and magnetic elements 12-1B and 12-2B also facing upwards i.e. front side 11B faces back side 21A of first flat member 10A. As a result, both ferromagnetic elements 12-1B and 12-2B of second member 10B are magnetically secured to back side 21A of first flat member 10A. Third flat member 10C is positioned under second flat member 10B, with its front face 11C facing down. As a result, back sides 21B and 21C of members 10B and 10C are adjacent to one another and are magnetically attracted to one another by the magnetic forces of the ferromagnetic elements 12 on each of members 10.

The convex rear sides 21 of members 10 facilitate separating adjacent members 10 by sliding distal end 17 of one member 10 transversely relative to distal end 17 of adjacent member 10, so that first end 16 pivots about ring 40.

Magnetic holder 1 may be used as follows. Ferromagnetic elements 12 on members 10A and 10C (i.e. ferromagnetic elements 12-1A, 12-2A, 12-1C and 12-2C) face outward and will therefore constitute the point of contact with any ferrous material which is brought into close vicinity of holder 1. For example, any ferrous coins in proximity of magnetic holder 1 are magnetically attracted to and attach to the outwardly facing magnetic elements 12-1A, 12-2A, 12-1C and 12-2C, on members 10A and 10C. A user could for example, place holder 1 into a pocket containing various magnetic coins and the coins would become attached magnetically to holder 1.

Since holder 1 is magnetic it can be attached to any object of magnetic material. For example, holder 1 can be magnetically secured to a large ferrous object, such as a refrigerator door or tool box by placing one of the sets of outwardly facing magnetic elements (for example 12-1A and 12-2A) against the object. The remaining pair of outwardly facing magnetic elements (for example 12-1C and 12-2C) can magnetically hold directly small magnetic objects. Therefore, one aspect of magnetic holder 1 is that it comprises magnetic elements which cause it to attract, or be attracted to, magnetic objects. A user could, for example, keep keys on ring 40 and store the keys conveniently by placing holder 1 on a refrigerator door.

Figure 3:
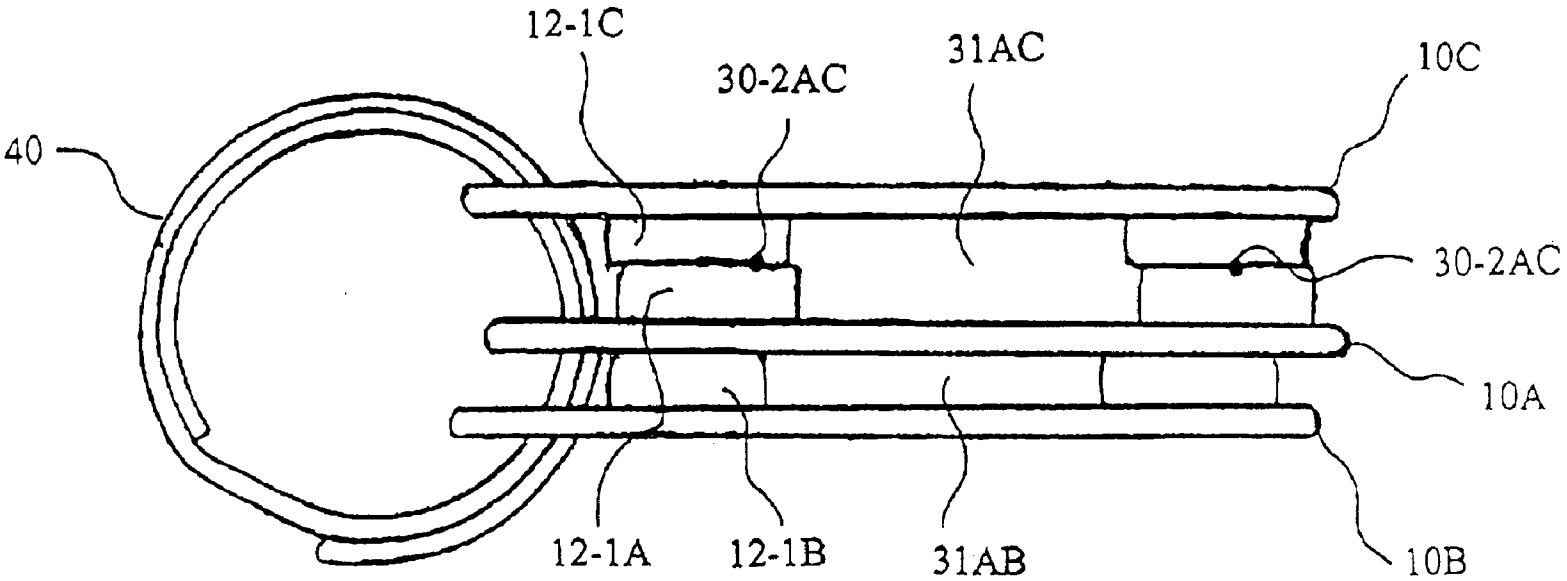
FIGS. 3 and 4 show a schematic side view of alternate arrangements of individual parts of the holder according to the currently preferred embodiment of the invention.
Figure 4:
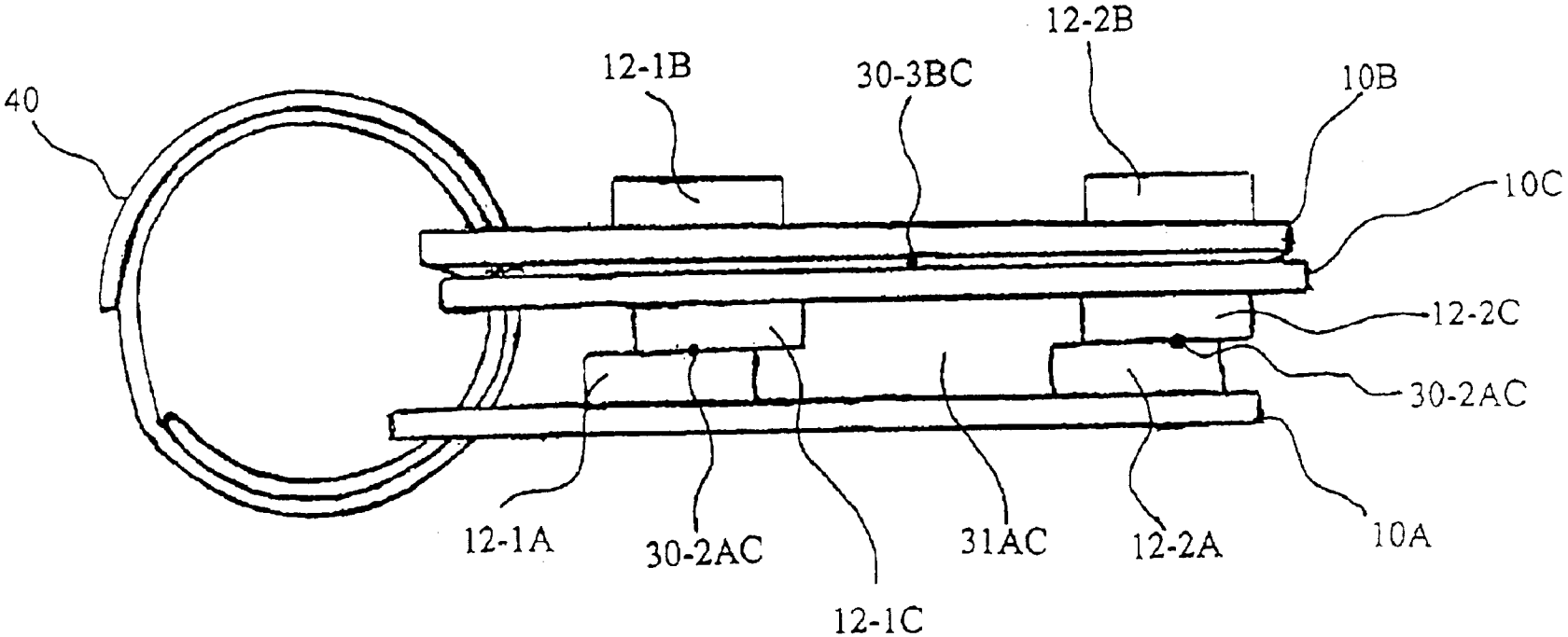

Various contact areas 30 lie between adjacent members 10. One contact area 30-1 is formed by a pair of magnetic elements 12-1 and 12-2 coming in contact with the back side 21 of a member 10 (for example, as shown in FIG. 2, contact area 30-1AB formed by magnetic elements 12-1B and 12-2B coming in contact with back side 21A of member 10A). Another contact area 30-2 is formed by a pair of magnetic elements 12-1 and 12-2 coming in contact with another pair of magnetic elements 12-1 and 12-2 (for example, as shown in FIGS. 3 and 4, contact area 30-2AC formed by magnetic elements 12-1C and 12-2C of member 10C coming in contact magnetic elements 12-1A and 12-2A of member 10A). Another contact area 30-3 is formed by the back side 21 of a member 10 coming in contact with the back side 21 of another member 10 (for example, as shown in FIG. 4, contact area 30-3BC formed by back side 21B of member 10B coming in contact with back side 21C of member 10C).

In the preferred embodiment of the invention there are two contact areas 30 which lie between adjacent members 10. Between members 10B and 10C is a first area 30-3BC. Since members 10B and 10C are magnetically attracted to one another, an object placed in or passing through area 30-3BC will tend to be pinched between members 10B and 10C. For example, paper currency or identification cards can be inserted between back sides 21B and 21C of members 10B and 10C and retained by the forces attracting member 10B to member 10C. Because of the presence of magnetic fields, cards adversely affected by such fields should not be used with magnetic holder 1 (magnetically encoded credit cards would therefore not be good candidates to be secured within magnetic holder 1). However, any other thin object may be held by magnetic holder 1, between flat members 10B and 10C.

A second contact area 30-1AB capable of holding thin objects is located between first member 10A and second member 10B. Note that contact area 30-1AB distally located from apertures 15 is more easily accessible.

Because magnetic elements 12 project slightly from the front faces 11 of the members 10, where two members 10 are adjacent to one another with the front face 11 of one member 10 against the back side 21 of another member 10, an elongated closed gap 31 exists between the members 10. Objects can be held to holder 1 by separating the adjacent members 10 placing the objects through the gap 31 and allowing members 10 to become magnetically secured to one another with the object passing through gap 31. Objects comprising rings, loops, closed straps or the like can be affixed to holder 1 in this manner. Conversely, holder 1 can be secured to an object which includes a loop element such as a belt loop on a user's pants.

Gap 31 could also be formed between spacers which project from a member 10 and be provided in addition to ferromagnetic elements 12.

In the preferred embodiment, there is at least one gap 31AB between member 10A and member 10B.

As noted above, objects can also be fixed in any conventional manner to aligning member, such as ring 40. Ring 40 or an alternative aligning member could also be used to secure holder 1 to a loop such as a belt loop on a user's pants, another key ring, or the like.

Preferably, the aligning member allows members 10 to be repositioned with respect to one another. More specifically, ring 40 or an alternative aligning member preferably allows a user to selectively position second flat member 10B either in between members 10A and 10C (i.e. as shown in FIG. 2) or at either ends of the trio of members 10A, 10B and 10C (i.e. on the bottom as shown in FIG. 3 or on top as shown in FIG. 4).

In the configuration of FIG. 3, there are no outwardly facing magnetic elements 12. Thus, in this configuration holder 1 generates less in the way of stray magnetic fields, but forms two closed gaps 31AB and 31AC instead of just one (as in the configuration shown in FIGS. 1 and 2). Consequently, in this configuration, holder 1 is less able to attract and hold small magnetic objects and less able to hold itself to a larger magnetic object.

In the configuration of FIG. 4, there are only two outwardly facing magnetic elements 12 (as opposed to four in the configuration shown in FIGS. 1 and 2). However, holder 1 provides a larger closed gap 31AC (as opposed to the smaller closed gap 31-AB provided in the preferred embodiment of FIGS. 1 and 2) for holding loop-type objects. Consequently, in this configuration, holder 1 is less able to attract and hold small magnetic objects and less flexible in holding itself to a larger magnetic object.

Conversely, the magnets which create closed gap 31AC (i.e. magnets 12-1A and 12-1C on one end and magnets 12-2A and 12-2C on the other) can strongly grip most material passing through area 30-2AC, while the remaining two magnets (i.e. magnets 12-1B and 12-2B) can attach the holder, and by extension said material, to any ferrous object. Such configuration could therefore be used to hold an edge of a covering sheet, such as a car cover sheet, against a ferrous portion of an object to be covered, such as a vehicle's bumper. More specifically, the car cover sheet would be held via area 30-2AC, with holder 1 being held on the vehicle's bumper via magnets 12-1B and 12-2B. In this respect, holder 1 can be used to secure edges of a tarpaulin against a car/truck's metal parts, edges of a cover sheet against a boat's metal parts etc.

Pursuant to this invention, it is possible for a holder to include only 2 (instead of three) members 10. However, this is not preferred as a holder including only 2 members 10 would not be able to provide, at the same time, closed gaps, adjacent pinching faces and outwardly facing magnets. Consequently, a holder including only 2 members 10 would not be as flexible in terms of options offered to a user.

Also, members 10 may be made of non magnetizable material, which is not preferred as this would reduce the magnetic force keeping all members 10 magnetically secured to one another. However, such a disadvantage could be remedied by using stronger ferromagnetic elements 12.

As will be apparent to those skilled in the art in the light of the foregoing disclosure, many alterations and modifications are possible in the practice of this invention without departing from the spirit or scope thereof. For example:

- embodiments of the invention may provide four or more members 10;
- it is possible to have members 10 further slightly curved or slightly bent about a longitudinal axis and along the length of members 10 (as opposed to along the width of members 10, as shown in FIG. 6), with the ferromagnetic elements still sitting in members 10's concave portion;
- magnetic elements 12 may be embedded in members 10 instead of being surface-mounted, as described above; and
- in cases where a user is more interested in holder 1's ability to secure larger objects against a ferrous portion of another object and less in its ability to removably secure personal objects, the size of each flat member 10, and consequently of each ferromagnetic element 12, could be increased so as to no longer comfortably fit inside a typical clothing pocket but provide increased magnetic strength in securing larger objects against a ferrous portion of another object.

Accordingly, the scope of the invention is to be construed in accordance with the substance defined by the following claims.

What is claimed is:

1. A versatile magnetic holder, comprising three longitudinal magnetic members each comprising a magnetizable material, wherein each magnetic member comprises:

(a) an aperture through which a loop-shaped element can extend, positioned in an end portion of the magnetic member; and, (b) two ferromagnetic elements on the magnetic member.

2. A versatile magnetic holder, as recited in claim 1, wherein the ferromagnetic elements comprise rare-earth magnets.

3. A versatile magnetic holder, as recited in claim 1, comprising an aligning member extending through the aperture of each magnetic member.

4. A versatile magnetic holder, as recited in claim 3, wherein the aligning member comprises a ring.

5. A versatile magnetic holder, as recited in claim 3, wherein the aligning member comprises a key ring.

6. A versatile magnetic holder, as recited in claim 3, wherein the aligning member comprises a flexible strap.

7. A versatile magnetic holder, as recited in claim 3, wherein (a) the ferromagnetic elements project from a front face of each magnetic member, (b) each magnetic member is removably secured to the aligning member; and, (c) the magnetic members are arranged with respect to one another so that, when the three magnetic members are magnetically secured to one another, the front faces of two of the magnetic members face in one direction while the front face of a third magnetic member faces in an opposite direction.

8. A versatile magnetic holder according to claim 1 wherein a front face of each of the magnetic members comprises a spacer.

9. The versatile magnetic holder of claim 8 wherein the ferromagnetic elements project from the front face to serve as the spacer.

10. The versatile magnetic holder of claim 1 wherein:

a) each of the ferromagnetic elements has a north magnetic pole and a south magnetic pole, and b) each ferromagnetic element is arranged so that, when the three magnetic members are magnetically secured to one another, the poles of two closely adjacent faces of ferromagnetic elements attract one another.

11. The versatile magnetic holder of claim 1 wherein at least one magnetic member is curved along its longitudinal axis.

12. The versatile magnetic holder of claim 1 wherein at least one magnetic member has a convex back side.

13. A versatile magnetic holder, comprising:

(a) a ring;

(b) three longitudinal magnetic members, each magnetic member comprising an aperture, positioned at one extremity of the magnetic member, through which the ring can extend;

(c) two ferromagnetic elements projecting from a front face of each magnetic member;

wherein the magnetic members are secured to the ring by having the ring extend through the aperture of each magnetic member, and wherein, when the magnetic members are secured to the ring:

the front faces of two of the magnetic members face in one direction while the front face of a third magnetic member faces in an opposite direction, and the ferromagnetic elements are aligned with one another.

14. The versatile magnetic holder of claim 13 wherein each of the magnetic members is curved along its longitudinal axis and has a convex rear face.

15. The versatile magnetic holder of claim 13 wherein the holder is pocket-sized.

16. A method for simultaneously holding magnetic objects, loop shaped elements and thin articles, the method comprising:

(a) providing a holder, as recited in claim 7;

(b) inserting a thin article between a back side of one magnetic member and the back side of another magnetic member;

(c) magnetically securing a magnetic object to any one of the ferromagnetic elements; and (d) inserting a loop shaped element in a gap between:

(i) the front face of one magnetic member and the two ferromagnetic elements projecting from said front face, and (ii) the back side of another magnetic member to which said ferromagnetic elements are magnetically secured.

17. A method of holding magnetic objects, loop shaped elements and thin articles, the method comprising:

(a) providing a holder, as recited in claim 7;

(b) inserting a thin article between a back side of one magnetic member and the back side of another magnetic member;

(c) magnetically securing a magnetic object to any one of the ferromagnetic elements; and (d) inserting a loop shaped element in a gap formed by:

(i) the front face of one magnetic member and the two ferromagnetic elements projecting from said front face, and (ii) the front face of another magnetic member and the two ferromagnetic elements projecting from said front face, wherein each pair of ferromagnetic elements are magnetically secured to one another.

* * * * *